United States Patent [19]

Aichele et al.

[11] Patent Number: 4,732,327

[45] Date of Patent: Mar. 22, 1988

[54] INJECTION VALVE

[75] Inventors: Karl Aichele, Stuttgart; Wolfgang Kramer, Strullendorf; Ernst Lang, Gerlingen; Mathias Linssen, Litzendorf; Alois Stemmer, Vaihingen; Michael Wissmann, Markgröningen, all of Fed. Rep. of Germany

[73] Assignee: Robert Bosch GmbH, Stuttgart, Fed. Rep. of Germany

[21] Appl. No.: 947,795

[22] Filed: Dec. 30, 1986

Related U.S. Application Data

[62] Division of Ser. No. 725,522, Apr. 23, 1985, which is a division of Ser. No. 438,824, Nov. 3, 1982, abandoned.

[30] Foreign Application Priority Data

May 30, 1981 [DE] Fed. Rep. of Germany ..... 3121572

[51] Int. Cl.[4] ..... B05B 1/34

[52] U.S. Cl. ..... 239/463; 239/492; 239/533.12; 239/585; 239/600

[58] Field of Search ..... 239/490–492, 239/533.12, 585, 600, 463, 533.3–533.12

[56] References Cited

U.S. PATENT DOCUMENTS

| | | | |
|---|---|---|---|
| 2,719,755 | 10/1955 | Stanley | 239/492 X |
| 4,033,513 | 7/1977 | Long | 239/585 |
| 4,248,296 | 2/1981 | Jezek | 239/492 X |
| 4,394,973 | 7/1983 | Sauer et al. | 239/585 X |
| 4,416,423 | 11/1983 | Krauss et al. | 239/585 |
| 4,454,990 | 6/1984 | Lewis | 239/585 |
| 4,455,982 | 6/1984 | Hafner et al. | 239/585 X |

FOREIGN PATENT DOCUMENTS

| | | | |
|---|---|---|---|
| 014821 | 6/1956 | Fed. Rep. of Germany | 239/490 |

*Primary Examiner*—Andres Kashnikow
*Assistant Examiner*—Kevin Patrick Weldon
*Attorney, Agent, or Firm*—Edwin E. Greigg

[57] ABSTRACT

An injection valve for fuel injection systems in internal combustion engines which comprises a movable valve element cooperating with a valve seat disposed in a nozzle body, with a guide bore provided downstream of the valve seat. A swirl insert is partially compressed in the guide bore and disposes open swirl channels in the direction of its circumference. The swirl channels extend in an axial direction from one end of the swirl insert to the other, are slanted toward the longitudinal shaft of the injection valve and discharge in a tangential direction into a preparation bore. The swirl channels serve simultaneously as metering channels whose throttling length is adjustable by displacing the swirl insert inside the guide bore.

2 Claims, 9 Drawing Figures

INJECTION VALVE

This application is a division of pending application Ser. No. 725,522 filed Apr. 23, 1985, which is a continuation of Ser. No. 438,824 filed Nov. 3, 1982, now abandoned.

BACKGROUND OF THE INVENTION

The invention is based on an injection valve for fuel injection systems of internal combustion engines. A fuel injection valve with swirl channels provided in the nozzle body is already known. The bore processes required in an embodiment of this kind not only involve additional expenditures but at the same time define the shape and direction of the swirl channels.

OBJECT AND SUMMARY OF THE INVENTION

The injection valve according to the invention as revealed hereinafter has the advantage over the prior art that the swirl-spray injection valve with simultaneous fuel metering by way of the swirl channels can be designed and installed in a simple manner.

By means of characteristics disclosed, advantageous further developments and/or improvements of the injection valve described are possible. It is particularly advantageous to provide for a subsequent adjustment means for correcting the fuel quantity.

BRIEF DESCRIPTION OF THE DRAWINGS

Exemplary embodiments of the invention are shown in a simplified manner in the drawings, and are more clearly defined in the following description.

DESCRIPTION OF THE PREFERRED EMBODIMENTS

Figure 1:
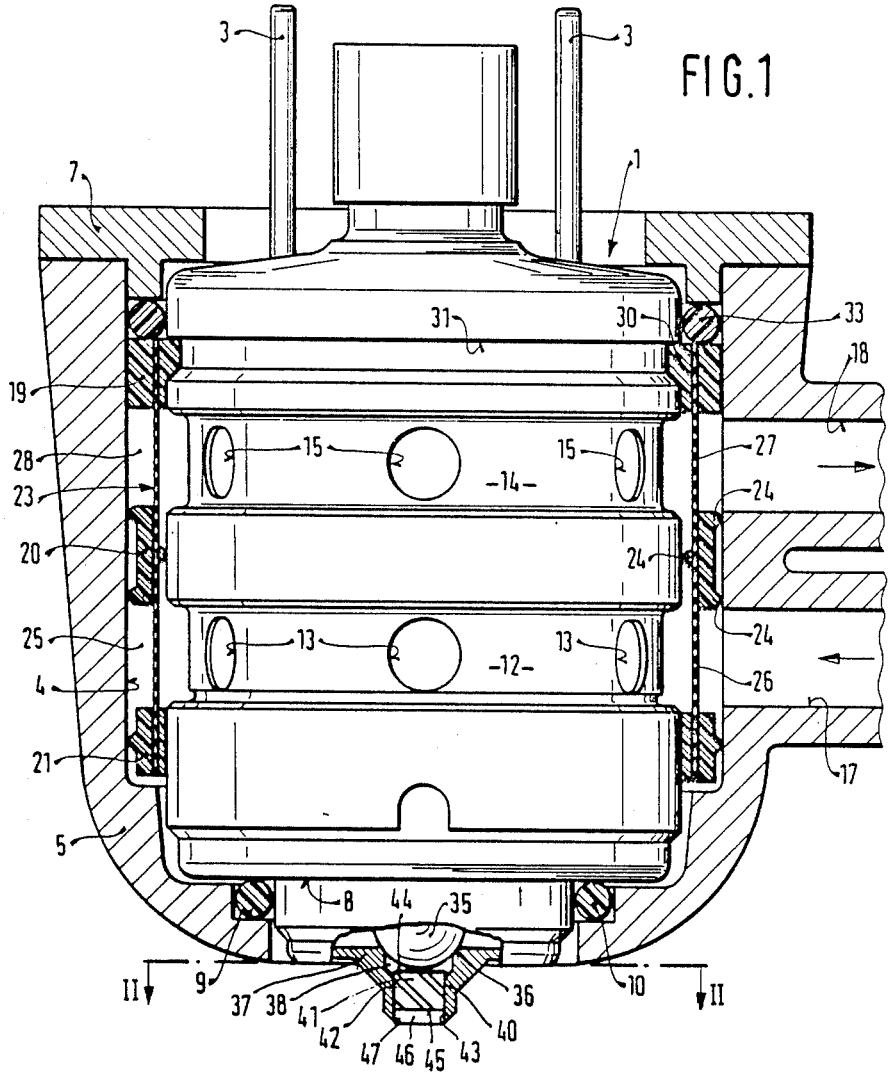
FIG. 1 shows an injection valve with a first exemplary embodiment of a swirl insert.

The fuel injection valve shown by way of example in FIG. 1 is electromagnetically actuatable in a known manner and serves, for example, to inject fuel, in particular at low pressure, into the air intake tube of mixture compressing internal combustion engines having externally supplied ignition. The fuel injection may be effected either simultaneously for all cylinders of the engine, upstream or downstream of a throttle valve, into the air intake tube by means of a single fuel injection valve, or else into the individual air intake tubes directly ahead of each inlet valve of each cylinder by means of individual fuel injection valves for each air intake tube. The electrical triggering of the fuel injection valve may be effected in a known manner via electrically conductive contact pins 3. The fuel injection valve is supported in a cylindrical guide opening 4 of a holder body 5 and may be fixed in the axial direction, for example, by a claw or a cap 7; a sealing ring 10 rests on the bottom end face 8 of the fuel injection valve, and is supported by the housing on a step 9 of the holder body 5. The holder 5 may be embodied by the wall of the air intake tube itself or as an independent part. The fuel injection valve 1 has an annular fuel supply groove 12, from which fuel inlet openings 13 lead into the interior of the fuel injection valve 1. The fuel injection valve 1 also has an annular fuel outflow groove 14 axially offset from the fuel supply groove 12 and shown opposite it in the drawing; from the fuel outflow groove 14, fuel outlet openings 15 lead into the interior of the fuel injection valve 1. A fuel supply line 17 discharges into the fuel supply groove 12 and communicates in a manner not shown with a fuel supply source, for instance a fuel pump. The fuel flows into the fuel supply groove 12 via the fuel supply line 17 and passes through the fuel inlet openings 13 into the interior of the fuel injection valve 1. The fuel is either ejected via the air intake tube or else passes through the fuel injection valve in order to absorb its heat and then exits via the fuel outlet openings 15 into the fuel outflow groove 14. The fuel outflow groove 14 communicates with a fuel outflow line 18 embodied in the holder body 5. The fuel injection valve 1 is radially guided in the guide opening 4 of the holder body 5 by elastic supporting bodies 19, 20, 21 of a fuel filter 23, which extends in the axial direction, covering the fuel supply groove 12 and the fuel outflow groove 14. The supporting bodies 19, 20, and 21 are fabricated of elastic material, such as rubber or plastic in particular. The middle supporting body 20 in particular is annularly embodied and is provided by way of example with sealing protrusions 24 such that it is supported on the circumference of the fuel injection valve 1 between the fuel supply groove 12 and the fuel outflow groove 14 on one side and on the guide opening wall surface 4 on the other, so that it seals off and separates the fuel supply groove 12 and the fuel supply line 17 from the fuel outflow groove 14 and the fuel outflow line 18. The fuel flowing in via the fuel supply line 17 first reaches an annular area 25 formed between the middle supporting body 20 and the lower terminal supporting body 21 of the fuel filter and flows out of this annular area 25 into fuel supply groove 12 via the filter area 26. The fuel can flow out of the fuel outflow groove 14 via the filter area 27 into an annular area 28 formed between the upper end supporting body 19 and the middle supporting body 20 of the fuel filter 23. The annular area 28 communicates with the fuel outflow line 18. Particles of soil contained in the fuel are filtered out by the filter areas 26, 27. Particularly because of the elastic embodiment of the middle supporting body 20, simpler machining and greater tolerances on the circumferences of the fuel injection valve 1 and in the diameter of the guide opening 4 are attainable. The upper supporting body 19 may be provided on its side oriented toward the fuel injection valve 1 with a detent nose 30, which when the fuel filter 23 is pushed onto the fuel injection valve comes to rest in a detent groove 31 of the fuel injection valve 1, so that the fuel injection valve 1 can be more easily inserted together with the mounted fuel filter 23 into the guide opening 3 of the holder body 5. A sealing ring 33 may likewise be axially supported on the upper supporting body 19, being disposed between the fuel injection valve 1 and the holder body 5 and fixed in place by end cap 7.

Figure 2:
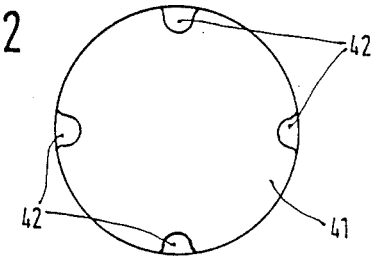
FIG. 2 is a section taken along the line II—II of FIG. 1.

The fuel injection valve 1 has a movable valve element 35, which is spherical by way of example, and which cooperates with a correspondingly shaped fixed valve seat 36 in a nozzle body 37. When the electromagnet of the fuel injection valve is excited, the movable valve element 35 is lifted off the valve seat, so that fuel can flow between the movable valve element 35 and valve seat 36 and on into a collection chamber 38 with a preferably low volume. Adjoining the collection chamber 38 is a guide bore 40 embodied on the nozzle body 37. A cylindrical swirl insert 41 is inserted partway into the guide bore 40 and has swirl chambers 42 which are open in the direction of its circumference. On the other end, the swirl channels are closed by the wall 43 of the guide bore 40. The swirl channels 42 are sloped in an axial direction from one end 44 in the collection chamber 38 to the other end 45 of the swirl insert 41 opposite the injection valve shaft. The swirl channels discharge in a tangential direction into the guide bore section 46 on whose wall the film of fluid is distributed and flows toward the sharp-edged open end 47 of the nozzle body 37 from which the still swirling fuel film breaks away and enters the air stream. In this manner the swirling fuel causes a uniform mixture of air and fuel, which is a basis for reduced fuel requirements and decreased amounts of toxic exhaust particles. The swirl channels at the same time serve as metering channels with a semi-circular cross-section which is rounded and transcends into the circumference of the swirl insert 41 as shown by way of example in FIG. 2. This includes at least two swirl channels 42 which are offset opposite one another in a predetermined angle. FIG. 2 shows four swirl channels 42 which are offset opposite one another in a 90° angle. The metered amount of fuel can be affected by the distance that the swirl channel 41 is compressed in the guide bore 40 so that a greater or lesser extent is covered by the wall 43 of the guide bore 40. Thus, even in a fixed state, a displacement of the swirl insert 41 effects an adjustment of the metered fuel quantity.

Figure 3:
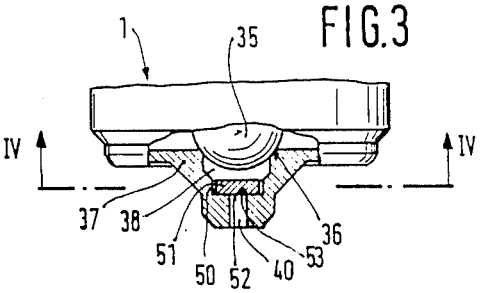
FIG. 3 is a second exemplary embodiment of a swirl insert with partial view of an injection valve.
Figure 4:
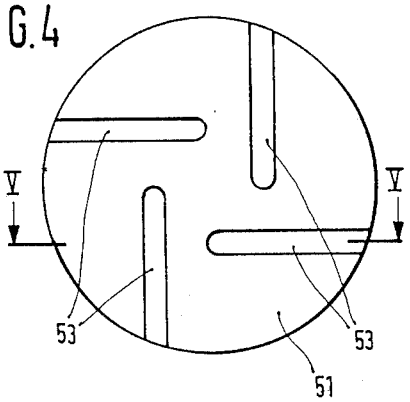
FIG. 4 is a section taken along line IV—IV of FIG. 3.
Figure 6:
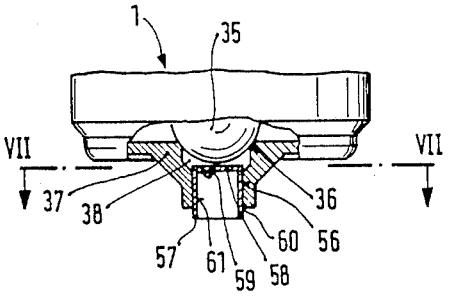
FIG. 6 is a third exemplary embodiment of an injection valve.
Figure 5:
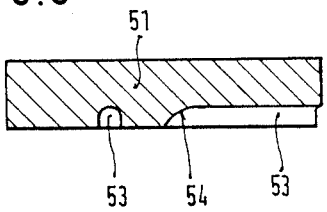
FIG. 5 is a section taken along line V—V of FIG. 4.

In a second exemplary embodiment, as shown in FIG. 3, the fuel injection valve 1 is only shown in partial view with the same identically operating elements being marked as in FIG. 1. The collection chamber 38, as shown by way of example in FIG. 3, transcends via a connection section 50 into guide bore 40 which has a smaller diameter. The collection chamber 38 includes therein a disc-shaped swirl insert 51 which abuts connecting section 50 with a face plane. As shown by way of example in FIGS. 4 and 5, the face plane 52 embodies swirl channels 53 which are open in the direction of face end 52 and are covered by a ring-shaped connecting section 50. The swirl channels 53 basically extend in a horizontal direction and transcend tangentially into guide bore 40 from where the fuel exits in a filmlike manner into the air stream. FIG. 4 shows four swirl channels 53 disposed in the swirl insert 51 which are displaced in a 90° angle relative to one another and extend in parallel pairs with a clearance toward the face plane axis which equals the radius of the guide bore 40. The swirl channels 53 originate on the circumference of the swirl insert 51 and terminate in a bore hole manner in a curved end 54 in the direction of face plane 52.

Figure 7:
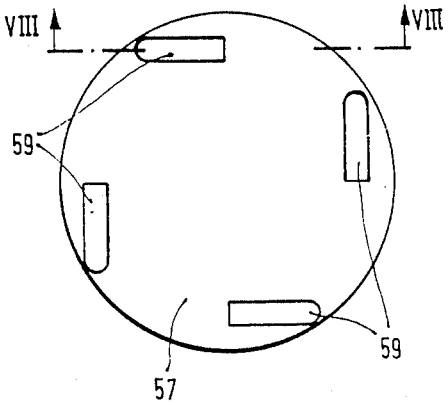
FIG. 7 is a section taken along line VII—VII of FIG. 6.
Figure 8:
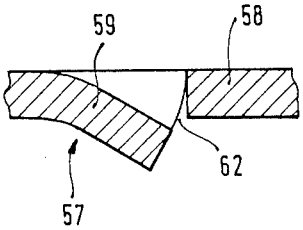
FIG. 8 is a section taken along line VIII—VIII of FIG. 7.

In the third and fourth embodiments of a swirl insert in accordance with FIGS. 6, 7, 8 and 9, which are also shown in partial view, a cup-shaped swirl insert 57 manufactured of sheet metal is formed with a bottom 58 and compressed in a guide bore 56 of the nozzle body 37 adjacent to collection chamber 38. Swirl inserts 59 are embodied in the bottom 58 of swirl insert 51, with the swirl channels slanted toward the longitudinal shaft of the injection valve and extending into a preparation bore 61 formed by a cylindrical wall 60 of the swirl insert 57 form where the fuel exits in a film-like manner with impact into the air stream. The swirl channels 59 serve as metering channels. FIG. 7 shows four swirl channels offset opposite one another in a 90° angle. As shown by way of example in FIG. 8, the outlet 62 of each swirl channel 59 runs off the insert bottom 58 and is sloped toward the inside of the swirl insert.

Figure 9:
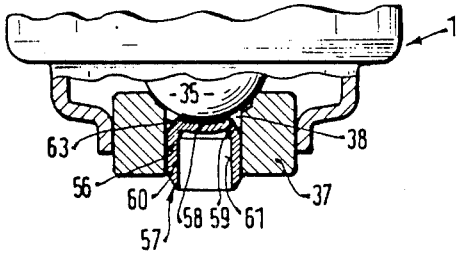
FIG. 9 is a fourth exemplary embodiment of a swirl insert.

In swirl insert 57, by way of example as shown in FIG. 9, the insert bottom 58 is provided with a oblique section 63, with swirl channels 59 originating at collection chamber 38 and extending in the form of bores in the direction of preparation bore 61.

The design of swirl inserts 41, 51, 57 in accordance with the exemplary embodiments allows for a simple design and installation of a fuel injection valve with impact-imposed fuel injection.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. An injection valve for fuel injection systems of internal combustion engines, comprising a nozzle body, a fixed valve seat provided on one end of said nozzle body, a movable valve element arranged to cooperate with said fixed valve seat provided on said nozzle body, said nozzle body comprises a guide bore of uniform diameter downstream of said valve seat, a cup-shaped swirl insert disposed downstream of said fixed valve seat and compressed in said guide bore, said valve seat is adjoined in a direction of fuel flow by a fuel collecting chamber (38) and said fuel collecting chamber is adjoined by said guide bore and said swirl insert, said swirl insert including a bottom (58) facing said valve seat (36), said bottom having a surface juxtaposed said valve element, a cylindrical outer wall (60) extending from said bottom in a fuel flow direction, a preparation bore (61) which opens in a direction remote from said valve seat and surrounded by said cylindrical wall, an oblique portion (63) extending from an outer surface of said bottom of said swirl insert adjacent to said valve element to an outer surface of said cylindrical wall (60) of said swirl insert, said swirl insert is provided with swirl channels (59) which originate along said oblique portion at the collection chamber (38) and are inclined downwardly relative to the longitudinal axis of the injection valve away from said wall (60) of said swirl insert into said preparation bore (61), whereby said swirl channels (59) meter an ejected quantity of fuel and discharge into the preparation bore (61).

2. An injection valve as claimed in claim 1 wherein said swirl insert is made from sheet metal.

* * * * *